US007501028B2

(12) United States Patent
Hammer et al.

(10) Patent No.: US 7,501,028 B2
(45) Date of Patent: Mar. 10, 2009

(54) NON-GRAIN ORIENTED MAGNETIC STEEL STRIP OR MAGNETIC STEEL SHEET AND METHOD FOR ITS PRODUCTION

(75) Inventors: Brigitte Hammer, Voerde (DE); Karl Ernst Friedrich, Moers (DE); Olaf Fischer, Bochum (DE); Jürgen Schneider, Bochum (DE); Carl-Dieter Wuppermann, Krefeld (DE)

(73) Assignee: ThyssenKrupp Stahl AG, Duisburg (DE)

( * ) Notice: Subject to any disclaimer, the term of this patent is extended or adjusted under 35 U.S.C. 154(b) by 404 days.

(21) Appl. No.: 10/514,983

(22) PCT Filed: May 15, 2003

(86) PCT No.: PCT/EP03/05114

§ 371 (c)(1),
(2), (4) Date: Jul. 1, 2005

(87) PCT Pub. No.: WO03/097884

PCT Pub. Date: Nov. 27, 2003

(65) Prior Publication Data

US 2005/0247373 A1 Nov. 10, 2005

(30) Foreign Application Priority Data

May 15, 2002 (DE) ..... 102 21 793

(51) Int. Cl.
*H01F 1/147* (2006.01)

(52) U.S. Cl. ..... 148/111; 148/306

(58) Field of Classification Search ..... None
See application file for complete search history.

(56) References Cited

U.S. PATENT DOCUMENTS 5,082,510 A * 1/1992 Nishimoto et al. ..... 148/111

(Continued)

FOREIGN PATENT DOCUMENTS

DE 0 431 502 6/1991

(Continued)

OTHER PUBLICATIONS

International Search Report PCT/EP03/05114 (PCT/ISA/210) (In German).

*Primary Examiner*—John P. Sheehan
(74) *Attorney, Agent, or Firm*—Proskauer Rose LLP

(57) ABSTRACT

The invention relates to non-grain oriented magnetic steel sheets which can be produced as final annealed and as a non-final annealed types in such a way that they have improved magnetic polarisation and reduced magnetic reversal losses compared with the previously achieved values. This is achieved in that a suitably composed steel, during its cooling starting from a maximum initial temperature of 1,300° C., passes through a temperature range with substantially complete exclusion of a purely austenitic structure (γ phase), in which range it comprises an austenite/ferrite dual phase multi-structure (α, γ multi-phases), so the magnetic steel sheet, after hot rolling, etching, cold rolling and annealing of the hot strip obtained after hot rolling, has a magnetic polarisation $J_{2500} \geqq 1.74$ T, measured in the longitudinal direction of the strip or sheet and at a magnetic field strength of 2,500 A/m and a value $P_{1.5}(50)$ of the magnetic losses of <4.5 W/kg, measured in the longitudinal direction of the strip at J=1.5 T and a frequency f=50 Hz.

15 Claims, 1 Drawing Sheet

U.S. PATENT DOCUMENTS

| | | | | |
|---|---|---|---|---|
| 5,116,435 | A * | 5/1992 | Nishimoto et al. | 148/111 |
| 5,258,080 | A * | 11/1993 | Burger et al. | 148/307 |
| 6,007,642 | A | 12/1999 | Gallo | |
| 6,503,339 | B1 * | 1/2003 | Pircher et al. | 148/120 |
| 6,773,514 | B1 * | 8/2004 | Kawalla et al. | 148/121 |
| 2001/0020497 | A1 | 9/2001 | Akihiro et al. | |
| 2003/0188805 | A1 * | 10/2003 | Friedrich et al. | 148/111 |
| 2004/0149355 | A1 * | 8/2004 | Kohno et al. | 148/111 |

FOREIGN PATENT DOCUMENTS

| | | |
|---|---|---|
| DE | 100 15 691 | 7/2001 |
| EP | 0 469 980 | 2/1992 |
| EP | 0 651 061 | 5/1995 |
| WO | 99 42626 | 8/1999 |
| WO | 01 02610 | 1/2001 |
| WO | WO 01/68925 A1 * | 9/2001 |

* cited by examiner

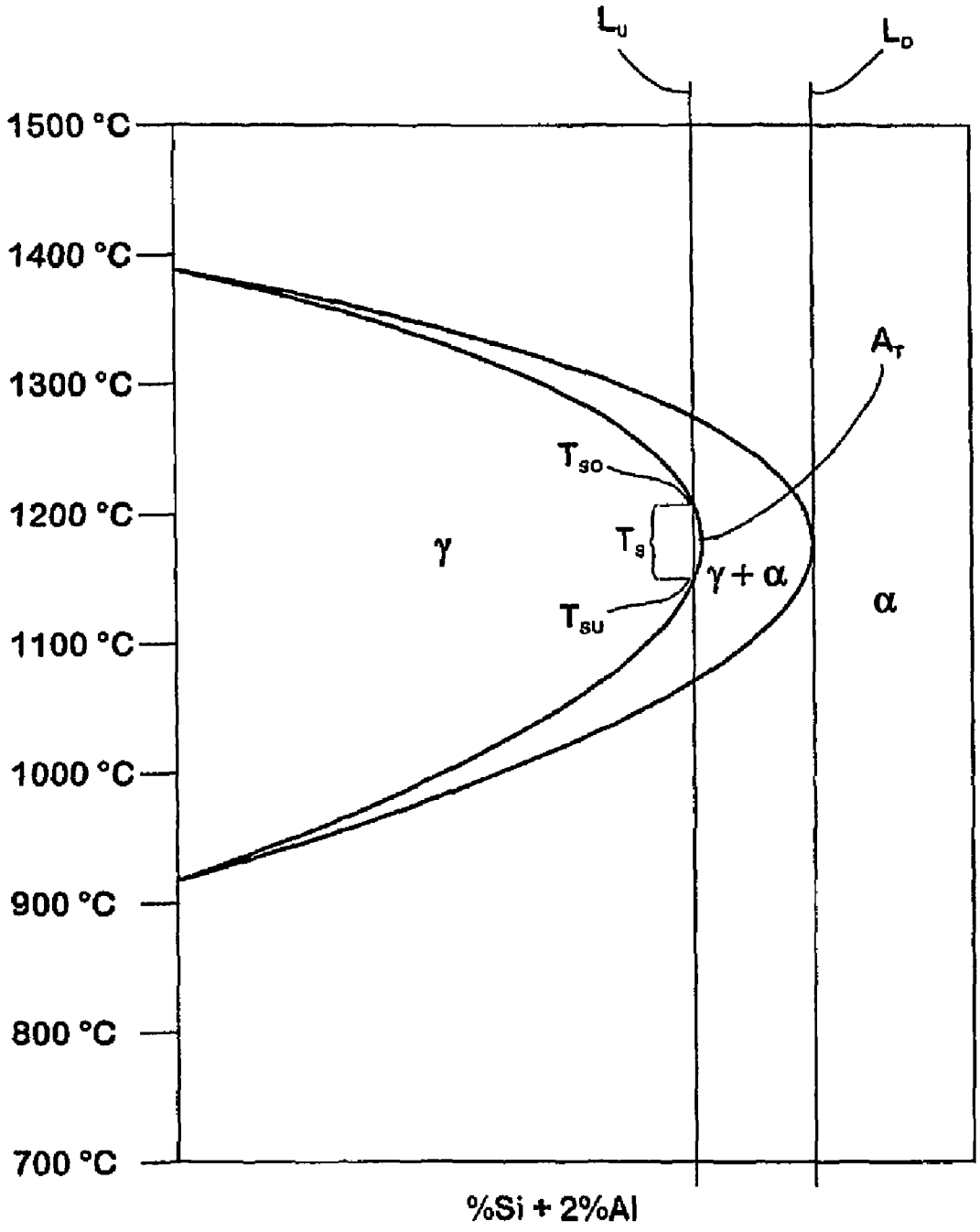
$L_U$
$L_D$
1500 °C
1400 °C
1300 °C
1200 °C
1100 °C
1000 °C
900 °C
800 °C
700 °C
$A_T$
$T_{SO}$
$T_S$
$T_{SU}$
γ
γ + α
α
%Si + 2%Al

NON-GRAIN ORIENTED MAGNETIC STEEL STRIP OR MAGNETIC STEEL SHEET AND METHOD FOR ITS PRODUCTION

FIELD OF THE INVENTION

The invention relates to a non-grain oriented magnetic steel strip or magnetic steel sheet and to a method for producing products of this type.

BACKGROUND OF THE INVENTION

The term "non-grain oriented magnetic steel sheet" is here taken to mean the magnetic steel sheets incorporated by DIN EN 10106 ("final annealed magnetic steel sheet") and DIN EN 10165 ("non-final annealed magnetic steel sheet"). More strongly anisotropic types are also included as long as they are not grain-oriented magnetic steel sheets. To this extent the terms "magnetic steel sheet" and "magnetic steel strip" are used synonymously here.

"J2500" and "J5000" hereinafter designate the magnetic polarisation at a magnetic field strength of 2,500 A/m or 5000 A/m. "P 1.5" is taken to mean the magnetic reversal loss at a polarisation of 1.5 T and a frequency of 50 Hz.

The demand to provide non-grain oriented magnetic steel sheets of which the magnetic polarisation values are increased compared with conventional sheets is made by the processing industry. This applies in particular to the areas of application in which the electrical machines are electrically excited. Increasing the magnetic polarisation reduces the magnetisation requirement. This is associated with a decrease in copper losses which in a large number of electrical machines constitutes a fundamental portion of the losses occurring during operation of electrical machines.

The economical value of non-grain oriented magnetic steel sheets with increased permeability is considerable. Electrical machines with electrical excitation, specifically industrial drives with outputs which amount to 1 kW to 100 kW and above constitute the main area of application of non-grain oriented magnetic steel sheet.

The demand for higher permeable non-grain oriented types of magnetic steel sheet relates not only to non-grain oriented magnetic steel sheets with high losses (P1.5≧5-6 W/kg) but also sheets with medium (3.5 W/kg≦P1.5≦5.5 W/kg) and low losses (P1.5≦3.5). Therefore, the aim is to improve the entire spectrum of weak-, mid- and high-silicon electrotechnical steels with respect to its magnetic polarisation values. The types of magnetic steel sheet with Si contents of up to 2.5 weight % have particular importance with respect to their market potential.

Types of magnetic steel sheet which have a high magnetic polarisation value $J_{2500}$ or $J_{5000}$ with low magnetic reversal loss values $P_{1.5}$ at 50 Hz, advantageously <4 w/kg, are specifically of interest as a reduction in the magnetic excitation current in the case of electrically excited machines and a reduction in the iron losses compared with conventional types of magnetic steel sheet with $P_{1.5}$>4 W/kg at 50 Hz can take place.

A reduction in the magnetic reversal losses may be achieved by increasing the Si content. Considerably reduced losses are thus established if the total % Si+2% Al formed from the Si content and twice the Al content in steels used for producing magnetic steel sheets of the type in question is more than 1.4%.

Various methods are known as to how for magnetic steel sheets having such high contents of Si and Al high $J_{2500}$ or $J_{5000}$ can be achieved. For this purpose, it was thus proposed in EP 0 651 061 A1 to achieve high degrees of reshaping during cold rolling, wherein cold rolling can be carried out in two stages using intermediate annealing. It is also known that higher permeable types of magnetic steel sheets can be produced by intermediate annealing of the hot strip (EP 0 469 980 B1, DE 40 05 807 C2). In accordance with the method known from EP 0 431 502 A2 a non-grain oriented magnetic steel sheet is ultimately produced in that steel input stock containing ≦0.025% C, <0.1% Mn, 0.1 to 4.4% Si and 0.1 to 4.4% Al (amounts in weight %) is initially hot rolled to a thickness of not less than 3.5 mm. The hot strip thus obtained is then cold rolled, without recrystallising intermediate annealing, with a degree of deformation of at least 86% and is subject to an annealing treatment. The strip produced in accordance with the known method has a particularly high magnetic polarisation of more than 1.7 T at a field strength $J_{2500}$ of 2500 A/m and low magnetic reversal losses.

However, in practice it has been found that using the known measures it is not possible, however, with the reliability required for large-scale production, to produce magnetic steel strips or sheets with total contents of Si and Al of more than 1.4 weight % which have a magnetic polarisation $J_{2500}$ of ≧1.7 T, measured in the longitudinal direction of the strip. (The values ascertained for $J_{2500}$ in the transverse direction of the strip and the multi-values of $J_{2500}$ are always smaller than the values of $J_{2500}$ measured in the direction of the strip).

Improvements with respect to higher values of $J_{2500}$ may be achieved when high-silicon alloys of very high purity, specifically with very low Si and Ti contents with simultaneously low C content, are used. However, this method requires additional expenditure in the steel production compared with the FeSi steels conventionally used in practice.

SUMMARY OF THE INVENTION

The object of the invention was accordingly to produce high quality non-grain oriented magnetic steel sheets, starting from the above-mentioned prior art, which can be produced both as final annealed and as non-final annealed types without additional manufacturing expenditure in such a way that they have improved magnetic polarisation and reduced magnetic reversal losses compared with the previously achieved values.

This object is achieved in accordance with the invention by a non-grain oriented magnetic steel strip or magnetic steel sheet with nominal thicknesses ≦0.75 mm, produced from a steel which, in addition to iron, contains the conventional unavoidable contents of impurities (for example S, Ti) and optionally present contents of Mo, Sb, Sn, Zn, W and/or V (in weight %) C: <0.005%, Mn: ≦1.0%, P: <0.8%, Al: <1% and Si providing that 1.4%<% Si+2% Al<2.5% (where % Si=Si content and % Al=Al content), wherein the thus composed steel, during its cooling starting from a maximum initial temperature of 1,300° C., passes through a temperature range with substantially complete exclusion of a purely austenitic structure (γ phase), in which range it comprises an austenite/ ferrite dual phase multi-structure (α, γ multi-phases), so the magnetic steel sheet, after hot rolling, etching, cold rolling and annealing of the hot strip obtained after hot rolling, has a magnetic polarisation $J_{2500} \geqq 1.74$ T, measured in the longitudinal direction of the strip or sheet and at a magnetic field strength of 2,500 A/m and a value $P_{1.5}$ (50) of the magnetic losses of <4.5 W/kg, measured in the longitudinal direction of the strip at J=1.5 T and a frequency f=50 Hz.

The above-stated object is also achieved by a method for producing a non-grain oriented magnetic steel strip or magnetic steel sheet composed according to any one of the preceding claims, comprising the following steps:

casting a steel which, in addition to iron, contains the conventional unavoidable contents of impurities (for example S, Ti) and optionally present contents of Mo, Sb, Sn, Zn, W and/or V (in weight %) C: <0.005%, Mn: ≦1.0%, P: <0.8%, Al: <1% and Si providing that 1.4%<% Si+2% Al<2.5% (where % Si=Si content and % Al=Al content) to form a fabricated material such as a slab, a thin slab or a cast strip, processing the fabricated material to form a hot strip in a hot rolling process at hot rolling temperatures which, starting from ≦1,300° C., are adjusted in such a way that with substantially complete exclusion of a purely austenitic structure (γ phase) a temperature range is passed through in which the processed steel has an austenite/ferrite dual phase multi-structure (α, γ multi-phases) and a ferrite region, so the magnetic steel strip or magnetic steel sheet, after a surface treatment including etching, cold rolling and annealing of the hot strip obtained after the hot rolling process, has a magnetic polarisation $J_{2500} \geqq 1.74$ T, measured in the longitudinal direction of the strip or sheet and at a magnetic field strength of 2,500 A/m and a value $P_{1.5}$(50) of the magnetic losses of <4.5 W/kg, measured in the longitudinal direction of the strip at J=1.5 T and a frequency f=50 Hz.

Surprisingly, it has been found that by selecting a suitably composed steel alloy and as a result of the particular temperature control during heat processing of the fabricated material cast from this steel alloy, a magnetic steel sheet may be produced which has much improved magnetic loss and magnetic permeability values compared with the prior art. Magnetic polarisation $J_{2500}$, measured in the longitudinal direction, of at least 1.74 T, in particular at least 1.76 T even, may thus be ensured with magnetic steel sheets composed in accordance with the invention. Magnetic losses $P_{1.5}$ of less than 4.5 W/kg, specifically 4 W/kg, may also be guaranteed.

The prerequisite for this is that the steel used in accordance with the invention is composed such that, with cooling starting from 1,300° C., as far as possible it does not have a purely austenitic structure at any point in time. Instead, the composition is to be selected such that during cooling, a temperature region is necessarily passed through within which the steel structure comprises a mixture of γ and α phases. A deviation from this provision which is still tolerable in accordance with the invention is if a pure austenite structure occurs above a temperature span of a maximum of 50° C. This means that for the event that a pure austenite structure forms, dual phase multi-structures have to exist at the latest after a drop in temperature by a further 50° C.

It could be proven that at a deviation which goes 50° C. beyond the temperature tolerance range, the increase in quality of magnetic steel sheets achieved by the invention cannot be attained. The temperatures are thus preferably controlled during the production of magnetic steel strips in accordance with the invention in such a way that the critical temperature span is avoided. For this purpose, by way of example, the re-heating temperature of the slab in the conventional hot strip production process, or the temperature of the thin slab during continuous casting and rolling or thin strip casting, can therefore be selected prior to hot rolling such that it is above the dual phase region. The hot rolling end temperature is >800° C.

If the hot strip processing includes coiling, then the coiler temperature at which the hot strip is coiled after the hot rolling process should be <650° C.

If during production of magnetic steel sheets in accordance with the invention slabs or relatively thick thin slabs are processed, the hot rolling process conventionally includes final rolling (final hot rolling) which takes place in a hot rolling group of stands comprising a plurality of rolling stands. To produce particularly high quality magnetic steel sheets the total degree of reshaping achieved in the course of final rolling should be >75%. Magnetic steel sheets which have magnetic polarisation values $J_{2500}$ of more than 1.74 T with particularly low losses $P_{1.5}$ of much less than 4 W/kg may be produced in that the degree of reshaping achieved in the course of final rolling in the dual phase multi-region is at least 35%.

Magnetic steel sheets with good properties in accordance with the invention may also be produced when the respective hot rolled fabricated material, prior to its entry into the hot rolling group of stands, is cooled, while passing through the dual phase multi-region, to the extent that final rolling during hot rolling takes place substantially with a ferritic structure of the processed steel.

When final rolling during hot rolling is carried out with the steel in the ferritic state, hot rolling preferably takes place with lubrication in at least one of the last reshaping passes. Hot rolling with lubrication results, on the one hand, with fewer shear deformations, so the rolled strip has a more homogenous structure over the cross-section as a result. On the other hand, lubrication reduces the rolling forces, so a greater decrease in thickness is possible over the respective roll pass. It can therefore be advantageous when all reshaping passes taking place in the ferrite region are carried out with roll lubrication.

Improved surface properties of magnetic steel sheets in accordance with the invention may be achieved in that, prior to etching, the hot strip is mechanically de-scaled in the course of its surface treatment.

Final annealing of the magnetic steel strip final cold rolled from the hot strip can basically take place in a conveyor furnace or in a bell-type furnace (final annealed magnetic steel strip). Alternatively, the annealed strip can be reshaped with a degree of reshaping of <12% after annealing in the conveyor or bell-type furnace and then be subjected to reference annealing at temperatures above 700° C., so a non-final annealed magnetic steel strip is then obtained.

DETAILED DESCRIPTION OF THE INVENTION

The invention will be described in more detail hereinafter with reference to embodiments.

The accompanying graph shows the phase graph of a binary FeSi alloy. Analogous graphs apply to industrial alloys, the respective "temperatures" changing with respect to those in the illustrated binary alloy.

In the graph the regions in which there is a purely ferritic ($\alpha$), a purely austenitic ($\gamma$) or a dual phase multi-structure formed from ferrite and austenite ($\alpha+\gamma$) are plotted as a function of the respective temperature and the total "% Si+2% Al" formed from the respective Si content and double the Al content of the respectively processed steel. In addition, the region within which alloys selected in accordance with the invention are located is delimited by the lines $L_U$, $L_O$ extending parallel to the axis of the temperatures.

It has been found that the line $L_U$ marking the lower limit of the total "% Si+2% Al" of the Si and Al contents of alloys processed in accordance with the invention, over a temperature span $T_S$, cuts the austenite phase region $\gamma$ expanding to smaller amounts of the total "% Si+2% Al", in which region pure austenite is formed. The temperature difference between the upper point of intersection $T_{SO}$ and the lower point of intersection $T_{SU}$ of the line $L_U$ with the austenite phase region $\gamma$ is less than 50° C. The section $A_T$ cut off from the austenite phase region $\gamma$ by the line $L_U$ in the direction of the line $L_O$ therefore constitutes the tolerance range enclosed by the dual phase multi-region ($\gamma+\alpha$), within which range pure austenite is allowed to form during implementation of the invention.

By contrast the line $L_O$ marking the upper limit of the total "% Si+2% Al" of the Si and Al contents of alloys processed in accordance with the invention still just about touches the limit of the dual phase multi-region ($\gamma+\alpha$), within which the dual phase multi-structures are produced. Any alloy in accordance with the invention, which has a value of its total "% Si+2% Al" lying between the lines $L_U$ and $L_O$, thus passes through the dual phase multi-region ($\gamma+\alpha$) during cooling from an initial temperature lying below 1,300° C.

To prove the effect of the invention, two steels S1 and S2, of which the compositions are indicated in table 1 (details in weight %, remainder: iron and unavoidable impurities), were melted.

TABLE 1

| | C | Si | Mn | Al | N | % Si + 2% Al | Cu | Sn | P | S | Ti |
|---|---|---|---|---|---|---|---|---|---|---|---|
| S1 | 0.0019 | 1.59 | 0.23 | 0.126 | 0.0014 | 1.842 | 0.008 | <0.002 | 0.053 | 0.003 | 0.0019 |
| S2 | 0.0034 | 1.67 | 0.27 | 0.06 | 0.002 | 1.79 | — | — | 0.048 | 0.003 | 0.0012 |

The alloy of the steel S1 is selected in this case in such a way that at no point in time during its cooling starting from 1,300° C. does the structure of the steel S1 consist of pure austenite $\gamma$. By contrast, in steel S2, in the course of its cooling, a purely austenitic structure is briefly produced from the previously dual phase multi-structure $\gamma+\alpha$ for a temperature span $T_S$ amounting to less than 50° C., which structure, on a further decrease in temperature, then immediately changes into a dual phase multi-structure $\gamma+\alpha$ again.

The steels S1 and S2 were each cast into slabs which were then re-heated to a temperature lying below 1,300° C. but above the limit temperature for transition marking the transition to the dual phase multi-region ($\gamma+\alpha$). At this re-heating temperature the slabs each had a purely ferritic structure.

The slabs were then pre-rolled and in the course of four different tests 1 to 4 passed at a hot rolling initial temperature into a hot rolling group of stands comprising seven rolling stands, in which they were final rolled into a respective hot strip.

In test 1 the hot rolling initial temperature of four slabs B1.1, B2.1, B3.1, B4.1 cast from the steel S1 was so high on entry into the hot rolling group of stands that the steel had a dual phase multi-structure formed from austenite and ferrite. In the hot rolling group of stands the slabs B1.1 to B1.4 were accordingly initially rolled in the dual phase multi-region. The degree of reshaping achieved during rolling in the dual phase multi-region was 40% and the degree of reshaping in the ferrite region 66%.

Rolling in the ferritic structure of the processed steel followed rolling in the dual phase multi-region. A degree of reshaping of 66% was achieved in the course of this rolling in the ferrite region. The hot strips final hot rolled from the slabs B1.1 to B1.4 left the hot rolling group of stands at a hot rolling end temperature ET and were coiled at a coiling temperature HT.

Table 2 shows the respective hot rolling end temperature ET in ° C., the coiler temperature HT in ° C. and the coiler holding time tH in min and the magnetic properties $P_{1.5}$ in W/kg, $J_{2500}$ and $J_{5000}$ in T in each case for the slabs B1.1 to B4.1 and the hot strips produced therefrom. Table 2 also shows the degrees of reshaping Ug $\gamma/\alpha$ achieved during rolling in the multi-region and the degrees of reshaping Ug $\alpha$ achieved during rolling in the ferrite region for the slabs B1.1 to B4.1.

TABLE 2

| test 1 | | | | | | | | |
|---|---|---|---|---|---|---|---|---|
| | ET | HT | tH | $P_{1.5}$ | $J_{2500}$ | $J_{5000}$ | Ug $\gamma/\alpha$ | Ug $\alpha$ |
| B1.1 | 850 | 600 | 5 | 3.906 | 1.746 | 1.820 | 40% | 66% |
| B2.1 | 850 | 600 | 15 | 3.865 | 1.753 | 1.827 | 40% | 66% |

TABLE 2-continued

| test 1 | | | | | | | | |
|---|---|---|---|---|---|---|---|---|
| | ET | HT | tH | $P_{1.5}$ | $J_{2500}$ | $J_{5000}$ | Ug γ/α | Ug α |
| B3.1 | 850 | 750 | 5 | 3.885 | 1.752 | 1.825 | 40% | 66% |
| B4.1 | 850 | 750 | 15 | 3.598 | 1.742 | 1.813 | 40% | 66% |

In test 2 the hot rolling initial temperature was so low that the five slabs B1.2 to B5.2 again cast from the steel S1 had a purely ferritic structure after their structure had passed through the dual phase multi-region (γ+α) in the course of their cooling. Hot rolling in the hot rolling group of stands was therefore exclusively carried out in the ferrite. A total degree of reshaping Ug α of 80% was achieved. The surface of the strip was lubricated during the second and third passes.

Table 3 shows the respectively maintained hot rolling end temperature ET in ° C., the coiler temperature HT in ° C. and the coiler holding time tH in min and the magnetic properties $P_{1.5}$ in W/kg, $J_{2500}$ and $J_{5000}$ in T in each case for the slabs B1.2 to B5.2 and the hot strips produced therefrom.

TABLE 3

| test 2 | | | | | | | |
|---|---|---|---|---|---|---|---|
| | ET | HT | tH | $P_{1.5}$ | $J_{2500}$ | $J_{5000}$ | Ug α |
| B1.2 | 850 | 600 | 5 | 3.532 | 1.776 | 1.825 | 80% |
| B2.2 | 850 | 600 | 15 | 3.665 | 1.762 | 1.831 | 80% |
| B3.2 | 850 | 750 | 5 | 3.508 | 1.743 | 1.813 | 80% |
| B4.2 | 850 | 750 | 15 | 3.885 | 1.758 | 1.827 | 80% |
| B5.2 | 850 | 800 | 5 | 3.783 | 1.770 | 1.839 | 80% |

As in test 1 the hot rolling initial temperature in test 3 was so high that, on entry into the hot rolling group of stands, the slabs B1.3, B2.3, B3.3, B4.3 cast from the steel S2 had a dual phase multi-structure formed from austenite and ferrite. In the hot rolling group of stands the slabs B1.3 to B4.3 were therefore initially rolled in the dual phase multi-region. The degree of reshaping Ug γ/α achieved during this rolling was 70%. Rolling in the ferritic structure of the processed steel followed rolling in the dual phase multi-region. A degree of reshaping Ug α of 33% was achieved in the course of this ferrite rolling.

Table 4 shows the respective hot rolling end temperature ET in ° C., the coiler temperature HT in ° C. and the coiler holding time tH in min and the magnetic properties $P_{1.5}$ in W/kg, $J_{2500}$ and $J_{5000}$ in T in each case for the slabs B1.3 to B4.3 and the hot strips produced therefrom.

| | ET | HT | tH | $P_{1.5}$ | $J_{2500}$ | $J_{5000}$ | Ug γ/α | Ug α |
|---|---|---|---|---|---|---|---|---|
| B1.3 | 900 | 600 | 5 | 3.715 | 1.757 | 1.829 | 70% | 33% |
| B2.3 | 900 | 600 | 15 | 4.186 | 1.778 | 1.848 | 70% | 33% |
| B3.3 | 900 | 750 | 5 | 4.408 | 1.776 | 1.846 | 70% | 33% |
| B4.3 | 900 | 750 | 15 | 4.344 | 1.781 | 1.851 | 70% | 33% |

In test 4 the hot rolling initial temperature was also selected in such a way that, on entry into the hot rolling group of stands, the three slabs B1.4, B2.4 and B3.4 cast from steel S2 had a dual phase multi-structure formed from austenite and ferrite. In the hot rolling group of stands the slabs B1.4 to B3.4 were therefore initially likewise rolled in the dual phase multi-region. However, in contrast to test 3, a relatively low degree of reshaping Ug γ/α of 40% was maintained here, however.

Rolling in the ferritic structure of the processed steel followed rolling in the dual phase multi-region. A degree of reshaping Ug α of 66% was achieved in the course of this ferrite rolling. The second and the third passes took place with lubrication of the surface of the strip. The final hot rolled hot strips left the hot rolling group of stands at a hot rolling end temperature ET and were coiled at a coiling temperature HT.

Table 5 shows the respective hot rolling end temperature ET in ° C., the coiler temperature HT in ° C. and the coiler holding time tH in min and the magnetic properties P1.5 in W/kg, $J_{2500}$ and $J_{5000}$ in T for the slabs B1.4 to B3.4 and the hot strips produced therefrom.

TABLE 5

| test 4 | | | | | | | | |
|---|---|---|---|---|---|---|---|---|
| | ET | HT | tH | $P_{1.5}$ | $J_{2500}$ | $J_{5000}$ | Ug γ/α | Ug α |
| B1.3 | 850 | 600 | 5 | 3.532 | 1.776 | 1.845 | 40% | 66% |
| B2.3 | 850 | 600 | 15 | 3.665 | 1.762 | 1.831 | 40% | 66% |
| B3.3 | 850 | 800 | 5 | 3.783 | 1.770 | 1.839 | 40% | 66% |

Table 6 shows, for comparison purposes, the magnetic properties $P_{1.5}$ in W/kg and $J_{2500}$ and $J_{5000}$ in T in each case for two conventionally produced magnetic steel sheets supplied by the Applicant under the trade name M 800-50 A and 530-50 AP, of which the alloy is composed with a Si content of 1.3% by weight such that it has a pronounced austenite region in the course of its production. The magnetic steel sheet M 800-50 A has, in the process, undergone a standard manufacture while the magnetic steel sheet 530-50 AP has been subjected to hot strip bell-type annealing in addition to the standard manufacture working steps.

TABLE 6

| comparison example | | | |
|---|---|---|---|
| | $P_{1.5}$ | $J_{2500}$ | $J_{5000}$ |
| M 800-50 A | 5.772 | 1.654 | 1.737 |
| 530-50 AP | 4.150 | 1.692 | 1.772 |

Table 7 shows, also for comparison purposes, the magnetic properties $P_{1.5}$ in W/kg and $J_{2500}$ and $J_{5000}$ for a magnetic steel sheet V.1 which was produced by the method described in DE 199 30 519 A1. The peculiarity of this method consists in the fact that hot rolling is carried out at least partially in the dual phase multi-region and in the process an overall change in shape $\epsilon_h$ of at least 35% is achieved.

Table 7 also shows the magnetic properties $P_{1.5}$ in W/kg and $J_{2500}$ and $J_{5000}$ for a magnetic steel sheet V.2 which was produced by the method described in DE 199 30 518 A1. The peculiarity of this method consists in the fact that, during hot rolling, at least the first reshaping pass is rolled in the austenite region and then one or more reshaping passes are carried out in the ferrite region with an overall change in shape $\epsilon_h$ of at least 45%.

TABLE 7

| | comparison example | | |
|---|---|---|---|
| Sheet | $P_{1.5}$ | $J_{2500}$ | $J_{5000}$ |
| V1.2 | 5.304 | 1.689 | 1.765 |
| V1.2 | 5.243 | 1.724 | 1.799 |

It has been found that neither the conventionally produced magnetic steel sheet qualities M 800-50 A or 540-50 AP nor the comparison sheets V1.1 and V1.2 attain the magnetic values, which the products in accordance with the invention have and which may be purposefully achieved in a procedure in accordance with the invention, even if measures are taken during hot rolling which go beyond the conventional method of production.

The invention claimed is:

1. Method for producing a non-grain oriented magnetic steel strip or non-grain oriented magnetic steel sheet, comprising the following steps:

casting a steel which, in addition to iron, contains unavoidable impurities (in weight %) C: <0.005%, Mn: ≦1.0%, P: <0.8%, Al: <1% and Si providing that 1.4%<% Si+2% Al<2.5% (where % Si=Si content and % Al=Al content) to form a fabricated material, processing the fabricated material to form a hot strip in a hot rolling process at hot rolling temperatures which, starting from ≦1,300° C., are adjusted in such a way that with substantially complete exclusion of a purely austenitic structure (γ phase) a first temperature range is passed through in which a processed steel has an austenite/ferrite dual phase multi-structure (α, γ multi-phases), so the magnetic steel strip or magnetic steel sheet, after a surface treatment including etching, cold rolling and annealing of the hot strip obtained after the hot rolling process, has a magnetic polarisation $J_{2500}$≧1.74 T, measured in a longitudinal direction of the strip or sheet and at a magnetic field strength of 2,500 A/m and a value $P_{1.5}(50)$ of magnetic losses of <4.5 W/kg, measured in the longitudinal direction of the strip at J=1.5 T and a frequency f=50 Hz, wherein a span, $A_T$, of a second temperature range within which the processed steel has the purely austenitic structure (γ phase) is less than 50° C., and wherein temperature during the hot rolling process is controlled while avoiding the span, $A_T$, of the second temperature range.

2. Method according to claim 1, wherein a temperature of the fabricated material reaches up to 1,150° C. before a start of the hot rolling process.

3. Method according to claim 2, wherein an end rolling temperature attained during the hot rolling process is >800° C.

4. Method according to claim 1, wherein the hot strip is coiled after the hot rolling process at a coiling temperature of less than 650° C.

5. Method according to claim 1, wherein the hot rolling process includes the final hot rolling which takes place in a hot rolling group of stands comprising a plurality of rolling stands.

6. Method according to claim 5, wherein a total degree of reshaping achieved during the final hot rolling is >75%.

7. Method according to claim 6, wherein a degree of reshaping achieved during the final hot rolling in the first temperature range in which the processed steel has the austenite/ferrite dual phase multi-structure is <45%.

8. Method according to claim 6, wherein a degree of reshaping achieved during the final hot rolling in the first temperature range in which the processed steel has the austenite/ferrite dual phase multi-structure is at least 35%.

9. Method according to claim 5, wherein the final hot rolling takes place exclusively at temperatures at which the steel exclusively has a ferrite structure.

10. Method according to claim 5, wherein a degree of reshaping achieved during the final hot rolling in the first temperature range in which the processed steel has the austenite/ferrite dual phase multi-structure is at least 35%, and hot rolling passes carried out in a ferrite structure of the processed steel take place with lubrication.

11. Method according to claim 1, wherein before etching, the hot strip is mechanically descaled during surface treatment.

12. Method according to claim 1, wherein a cold strip obtained after cold rolling is subjected to annealing in a conveyor furnace.

13. Method according to claim 12, wherein annealing takes place in a non-decarbonising atmosphere.

14. Method according to claim 1, wherein a cold strip obtained after cold rolling is subjected to annealing in a bell-type annealing furnace.

15. Method according to claim 12, wherein an annealed strip is reshaped with a degree of reshaping <12% and is then subjected to reference annealing at temperatures above 700° C., so a final annealed magnetic steel strip is obtained.

* * * * *